US005909844A

United States Patent [19]

Nilsson

[11] Patent Number: 5,909,844

[45] Date of Patent: Jun. 8, 1999

[54] WATER ATOMIZING NOZZLE FOR SNOW MAKING MACHINE

[75] Inventor: Lennart Nilsson, Östersund, Sweden

[73] Assignee: Lenko L Nilsson, Ostersund, Sweden

[21] Appl. No.: 08/952,432

[22] PCT Filed: Mar. 21, 1996

[86] PCT No.: PCT/SE96/00358

§ 371 Date: Nov. 20, 1997

§ 102(e) Date: Nov. 20, 1997

[87] PCT Pub. No.: WO97/01392

PCT Pub. Date: Jan. 16, 1997

[30] Foreign Application Priority Data

Jun. 27, 1995 [SE] Sweden ..... 9502328

[51] Int. Cl.[6] ..... F25C 3/04

[52] U.S. Cl. ..... 239/14.2; 239/406

[58] Field of Search ..... 239/14.2, 405, 239/406, 491, 493

[56] References Cited

U.S. PATENT DOCUMENTS

| | | | |
|---|---|---|---|
| 3,761,020 | 9/1973 | Tropeano et al. | 239/14.2 X |
| 3,908,903 | 9/1975 | Burns, Jr. | 239/406 X |
| 4,353,504 | 10/1982 | Girardin et al. | 239/14.2 |
| 4,742,959 | 5/1988 | Stanchak et al. . | |
| 5,090,619 | 2/1992 | Barthold et al. . | |
| 5,529,242 | 6/1996 | Hedin | 239/14.2 |

FOREIGN PATENT DOCUMENTS

| | | | |
|---|---|---|---|
| 132124 | 12/1981 | U.S.S.R. | 239/14.2 |

*Primary Examiner*—Andres Kashnikow
*Assistant Examiner*—Steven J. Ganey
*Attorney, Agent, or Firm*—Larson & Taylor

[57] ABSTRACT

A water atomizing nozzle adapted to be used in the type of snow making machines, in which water is disintegrated into very small water particles in a ring of atomizing nozzles surrounding an air channel through which air flows at high speed, and whereby the water droplets, which are carried by the air, freeze to snow or ice crystals and are allowed to fall to the ground some distance from the snow making machine. The atomizing nozzle comprises an outer hollow nozzle cone having an inner cone mounted therein, in which the inner cone with a front tip thereof is in bottom contact with the end of the outer cone, and in which there is formed a channel for feeder water between the inner and outer cones, and in which the inner cone is formed with a central air channel through which air of high pressure and high speed is moved straight through the inner nozzle cone and out through an outlet spray bore of the outer nozzle cone, and in which a swirl chamber for feeder water is provided between the outer and inner cones and from the swirl chamber a minor amount of water can be torn off and be carried out of the nozzle together with the flow of air, thereby forming a central plume of airborne nuclei, whereas the remaining part of the swirling feeder water is pressed out through the nozzle in the form of an outer hollow cone of cooled or frozen water droplets surrounding the plume of nuclei.

2 Claims, 2 Drawing Sheets

WATER ATOMIZING NOZZLE FOR SNOW MAKING MACHINE

Figure 1:
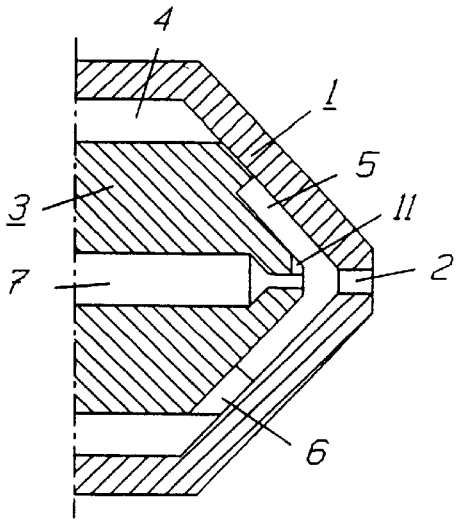

The present invention relates to a water atomizing nozzle adapted to be used in the type of snow making machines, in which water is atomized to very small droplets or water particles in a ring of spray nozzles surrounding an air channel through which air is blown at high speed, and whereby water droplets carried by the flow of air become freezed to snow or ice crystals and are allowed to fall to the ground some distance downstream the snow making machine.

In many cases the atomizing of the water is made under support of air which is supplied in common with water to each separate spraying nozzle.

Making of man made snow by means of a snow making machine involves several different problems. One problem can be that the snow or ice crystals which fall to the ground are not completely freezed throughout the crystals but contain a inner core of water. When such snow or ice crystals are compressed by a load they can be pressed to pieces so that the core of water is released, and this makes said water freeze to ice.

In order to eliminate said problem it has been suggested that the atomizing of the water be made so that there is formed, in each separate nozzle, en central flow of strongly freezed, very small water droplets, acting as a type of catalysts, so called nucleus (pl. nuclei), which spontaneously freeze to about −40° C. when leaving the spray nozzle. Said central flow of nuclei is surrounded by a shell of less strongly freezed water droplets which generally have a larger diameter than said nuclei, and which gradually get into contact with the strongly freezed nuclei and which thereby start a chain reaction in that said nuclei give off their refrigeration energy to the water droplets thereby contributing to making all, or at least nearly all of the water droplets become freezed throughout before they reach the ground.

Another problem is that there is generally a need for a very great amount of feeder air for forming the snow or ice crystals. The preparing of such feeder air constitutes a substantial part of the costs for the snow making process. The reason why the preparation of compressed air involves such high costs is that the air, for providing an effective freezing of the water droplets, must be strongly pressurized, often to more than a pressure of 4 bar, and must move at a high air speed, in particular supersonic flow speed.

It has since long been an aim to make it possible to reduce the amount of air which is needed for making man made snow, in order to thereby reduce the total costs for man making snow. At the same time there is a demand that as large part of the water droplets from the atomizing nozzles as possible become freezed throughout thereby providing the best possible quality of man made snow.

To this end the invention relates to a new type of atomizing nozzle for snow making machines, which nozzle is formed so that it is possible, while maintaining a very high quality of snow, to reduce the amount of air which is needed for making the snow by 50%, or even 60% as compared with the amount of air which has so far generally been needed. The nozzle according to the invention is also formed so as to provide a improved and wider spreading of the snow or ice crystals, whereby it may also be possible to reduce the necessary number of atomizing nozzles without reducing the amount of snow which is made per time unit.

The main idea of the invention is to create an inner plume of very strongly freezed, extremely small water droplets which act as a type of freezer catalysts, called nucleus (nuclei), for making further water droplets become freezed, and to create, exteriorly of said inner plume of nuclei, a hollow cone of less strongly freezed water droplets. This is made in that a little amount of the total flow of water (feeder water) through the atomizing nozzle, for instance 20% thereof, is discharged so as to be carried away by the air passing therethrough, whereby said discharged air flow provides an extreme fine atomizing of the water droplets, especially to a drop size of only about 10 $\mu$m, or even still less, and whereby said extremely small water droplets spontaneously freeze at about −40° C. depending on the expansion of the air with the finely atomized water droplets which fwhen leaving the outlet of the atomizing nozzle, thereby forming an inner plume of the so called nuclei.

The remaining amount of water, in the above mentioned case about 80% of the water, leaves the atomizing nozzle so that the water droplets therefrom form a hollow cone of less strongly freezed water droplets surrounding the plume of nuclei, and the water droplets of which generally have a size of about 50–100 $\mu$m. At the outer surface of the hollow cone of water droplets the ambient air acts with a relatively high pressure, and in the interspace between the outer hollow cone and the inner plume of nuclei in the air flow there is formed a sub-pressure zone. The outer, relatively high pressure and the inner sub-pressure contribute to sucking the outer hollow cone of water droplets and the inner air plume of nuclei together so that the water droplets of the hollow cone successively get into contact with the strongly freezed nuclei, primarily the inner very small droplets and thereafter the successively larger water droplets. The nuclei start a chain reaction making all water droplets of the outer cone become freezed. Some distance downstream the atomizing nozzle the inner plume and the outer cone have been fully united, and a flow of completely throughout freezed water droplets fall to the ground.

The nozzle according to the invention can be said to create a three stage process, namely stage 1: to create two separate flows consisting of an inner air plume containing super-freezed nuclei and an hollow outer cone of water droplets or less strongly freezed water droplets; stage 2: to bring the nuclei, outside of the nozzle, to freeze of the water droplets of the outer cone; stage 3: to move the cooled or freezed water droplets of the hollow outer cone into the inner air plume thereby providing a common flow of air/snow/ice.

According to the invention the atomizing nozzle comprises a outer hollow nozzle cone having an inner cone mounted therein, which with its tip is in contact with the downstream end of the outer cone, and in which there is formed a passageway for feeder water between the inner cone and the outer cone, and in which the inner cone is formed with a central air passageway through which air of high pressure and of supersonic speed is moved straight through the inner nozzle cone and out through a spray outlet bore of the outer nozzle cone. At the outer end of the nozzle, between the inner and outer cones, there is formed a swirl chamber for feeder water. From said swirl chamber a little portion of water can be torn off and moved out through the nozzle together with the flow of air to form a central plume of airborne nuclei, whereas the remaining part of the swirling feeder water is pressed out through the nozzle in the form of a hollow cone of water droplets surrounding the plume of nuclei.

Figure 2:
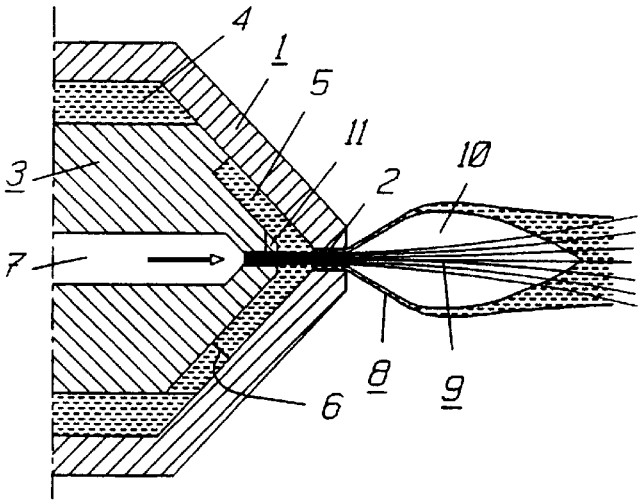
Figure 3:
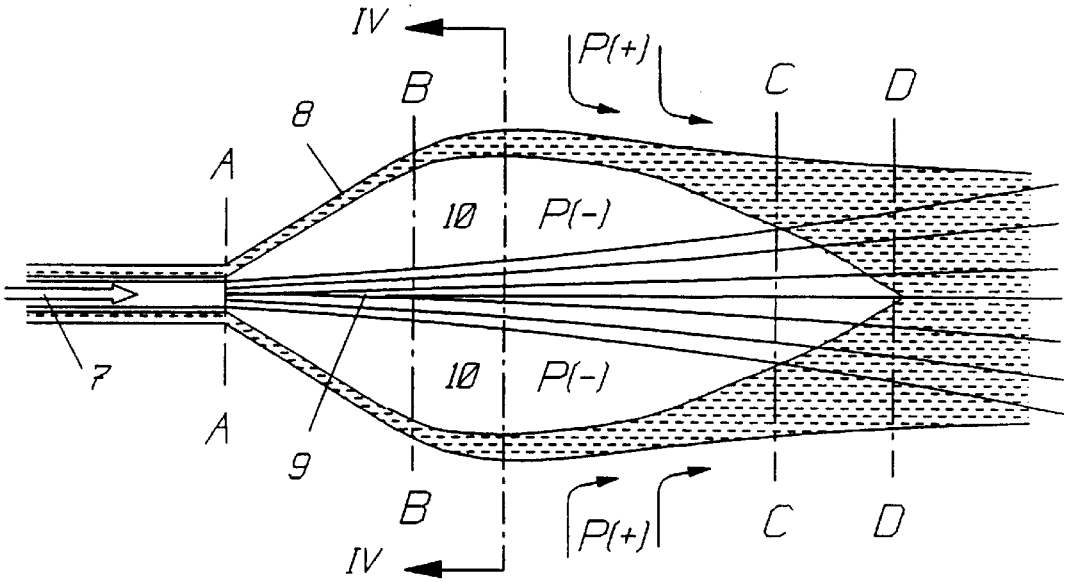
Figure 4:
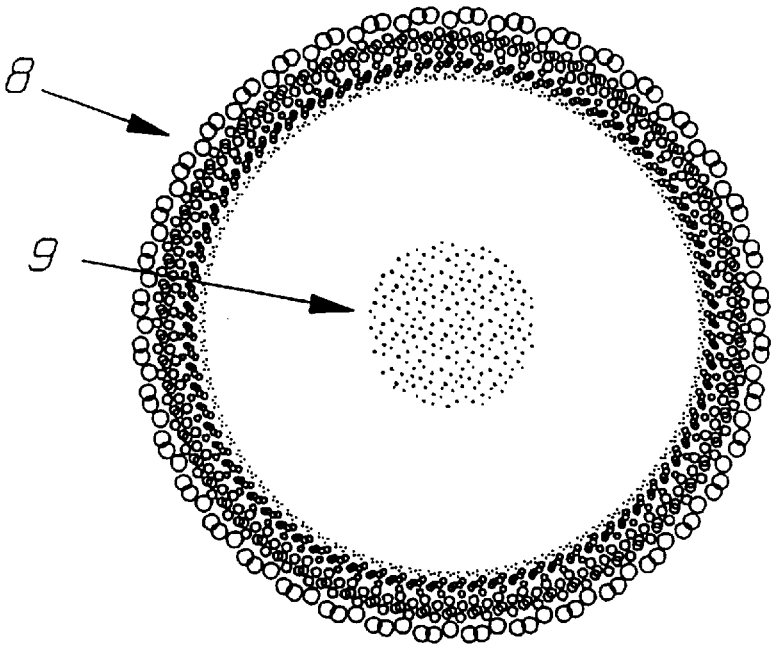
Figure 5:
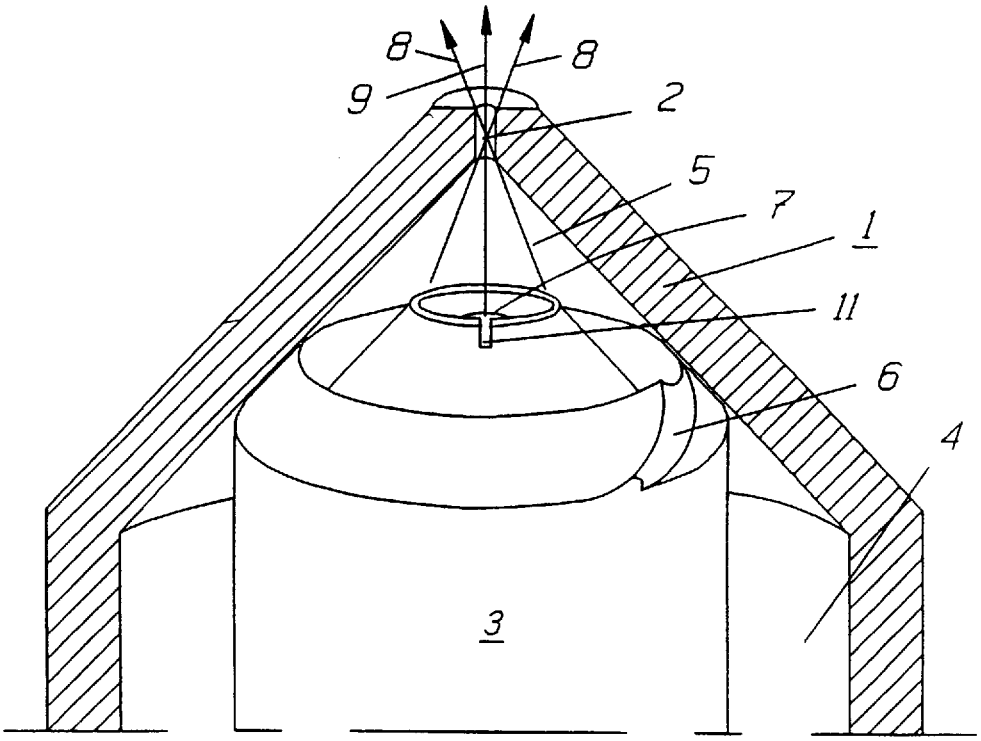

Further characteristics and advantages of the invention will be evident from the following detailed specification in which reference will be made to the accompanying drawings. In the drawings FIG. 1 shows a cross section through the vital outer end of an atomizing nozzle according to the invention. FIG. 2 shows, in the same type of view as that of FIG. 1, the nozzle during operation. FIG. 3 is a view in an enlarged scale of the nozzle of FIGS. 1 and 2. FIG. 4 is a cross section along line IV—IV of FIG. 3. FIG. 5, finally, diagrammatically and in a perspective view shows a cross section through a nozzle according to the invention.

The nozzle shown in the drawings comprises a hollow outer nozzle cone 1 having a spray nozzle bore 2 at a tip formed end thereof, and an inner distribution cone 3 which engages the bottom of the outlet end of the outer cone 1. The distribution cone 3 has less outer diameter than the inner diameter of the outer cone 1, and the annular space formed between the outer and inner cones acts as a water supply channel 4. The outermost end of the inner cone 3 is bevelled so that a space is formed between the outer and inner cones which is intended to provide a swirl chamber 5 for water which is pressed through one, eventually several obliquely extending or spirally formed slots 6 between the water channel 4 and the swirl chamber 5. An air channel 7 for feeder air extends centrally through the inner cone 3.

The water channel 4 is supplied with water having a pressure of for instance 10–15 bar, and the air channel 7 is supplied with air of supersonic speed and having a pressure of for instance 4–5 bar. In a special embodiment of the invention which has been tested and has found to give very good results, and which is referred to as a non-restricting example the outlet bore 2 of the outer cone 1 has a diameter of 1 mm, the water slot 6 has a width of 0.5 mm, the amount of air flow through the air channel 7 is 30 I/min and the air has a pressure of 4–5 bar, and the amount of water flow through the water channel is 0.5 I/min and has a pressure of 6–10 bar. It is very well possible to form the nozzle for substantially greater flows, for instance an air flow of up to 50 I/min and a water flow of 0.75 I/min, that is a relationship of water to air of about 1/55.

As most clearly indicated in FIG. 3 the water is pressed from the water channel 4, through the obliquely or in spiral formation extending water slot 6 and into the swirl chamber 5, in which the water is brought to swirl around depending on the spirally formed or oblique placing thereof, and the water finally leaves through the spray outlet bore 2 in the form of a hollow cone 8 of water droplets. During the swirl circulation of the water in the swirl chamber 5 the flow of water is slightly heated. Depending on the expansion when the air/water droplets leave through the outlet bore 2 all water droplets generally freeze. Normally the water droplets keep a droplet size of about 50–100 $\mu$m. The smallest droplets thereof form an inner layer, and the droplet size is gradually larger far out towards the periphery of the water droplet cone 8 as indicated in the diagrammatic view of FIG. 4.

The air from the air channel 7 passes with high pressure and at supersonic speed straight through the nozzle without meeting any intermediate wall, and the air thereby tears off and brings away an amount of water existing in the swirl chamber 5, for instance 20% of the total amount of water supplied to said swirl chamber. Depending on the high pressure and the high speed of the air the water brought away by the air is disintegrated into extremely small droplets, for instance a droplet size of 10$\mu$m or still less size. When the water/air mixture expands when leaving the outlet bore 2 of the spray nozzle the extremely small water droplets spontaneously freeze to an extremely low temperature, generally to about −40° C., and the air with super cooled water droplets, the so called nuclei, are brought straight forward in the form of an inner plume 9 of catalysts to some distance downstream the nozzle in a slightly widened cone shape.

Outside the outer hollow cone 8 of water droplets the ambient air acts with a positive pressure, and between said hollow cone 8 of water droplets and the inner plume 9 of nuclei there is a zone 10 having a sub-pressure which tends to draw the water droplets of the hollow cone 8 radially inwards to the nuclei 9, starting with the small, inner droplets and thereafter the successively larger water droplets. The nuclei start a chain reaction making all water droplets of the outer hollow droplet cone 8 become strongly freezed, generally completely freezed throughout. Some distance downstream the atomizing nozzle the water droplet cone 8 completely converges and merges into the inner plume 9 of nuclei, and finally an even flow of large and small water droplets which are freezed throughout fall to the ground.

The snow making by means of the above described nozzle can be said to include three different phases, namely phase 1: to provide two separate flows, an inner plume of air containing super freezed nuclei and an outer hollow cone of water droplets or less strongly freezed water droplets;

phase 2: to bring the nuclei to provide a freezing of the water droplets of the outer cone; and phase 3: to move the freezed water droplets of the outer cone to merge into the inner air/nuclei plume thereby forming an integral flow of air/snow/ice.

At point A of FIG. 3 both the water and the air leaves the outlet 4 of the nozzle. The extremely small water droplets of the air plume 9, which normally have a size of $\leqq 10$ $\mu$m, spontaneously freeze when leaving the nozzle, normally to a temperature of about −40° C. At point B the air speed of the air plume 9 has been reduced so that the flow of air with the nuclei starts widening conically. The water droplets form a hollow cone 8 of water droplets having a size of 50–100 $\mu$m which expands in the area between points A and B, whereby the small inner droplets freeze and the larger outer droplets become strongly cooled or at least partly freezed to ice. In the area between points B and C the outer cone 8 of water droplets turns to a more cylindrical shape at the same time as the small, inner water droplets thereof, which are normally already freezed, are sucked radially inwards towards the nuclei, in part depending on the sub-pressure existing in the sub-pressure zone 10. At point C water droplets 8 and airborne nuclei 9 start mixing with each other, and in the area between points C and D there is a successively increased mixing of water droplets 8 and nuclei 9, and this initiates a chain reaction with a freezing throughout of the water droplets, so that a homogeneous air flow of freezed water droplets follows downstream point D of FIG. 3.

For controlling the amount of water which is carried away by the air flow from the air channel 7 of the swirl chamber 5 said chamber 5 can be formed with an anti-swirl slot 11 which brakes a slight amount of water and makes it easy for the air to bring a slight amount of water while passing through the air channel and out through the spray nozzle bore 2. By giving the anti-swirl slot 11 a suitable shape, or by providing several such anti-swirl slots it is possible to control the amount of water droplets which are carried away by the air flow and which are formed to nuclei in the inner air plume 9.

It is thereby possible to control both the amount of water and the amount of air, and the invention is advantageous in that it has been possible to reduce the amount of air which is needed for creating sufficient amount of nuclei in order to make the entire amount of water leaving the nozzle become completely freezed to ice. This object has been fulfilled without reducing the amount of man made snow provided by the snow making machine.

| REFERENCE NUMERALS | | | |
|---|---|---|---|
| 1 | outer cone | 7 | air channel |
| 2 | outlet spray bore | 8 | outer cone |
| 3 | inner cone | 9 | inner plume |
| 4 | water supply channel | 10 | sub-pressure zone |
| 5 | swirl chamber | 11 | anti-swirl slot |
| 6 | water slot | | |

I claim:

1. Water atomizing nozzle for use in snow making machines in which water is disintegrated into very small water particles in a ring of atomizing nozzles surrounding an air channel through which air flows at high speed, and whereby the water droplets which are carried by the air freeze to snow or ice crystals and are allowed to fall to the ground some distance downstream the snow making machine, characterized in that the atomizing nozzle comprises an outer hollow nozzle cone having an inner cone mounted therein, which inner cone with a front tip thereof is in bottom contact with the outlet end of the outer cone, and in which there is formed a channel for feed water between the inner and outer cones, and in which the inner cone is formed with a central air channel through which air of high pressure and high speed is moved straight through the inner nozzle cone and out through an outlet spray bore of the outer nozzle cone, and in which swirl chamber for feeder water is provided between the inner and outer cones and from which swirl chamber a minor amount of water can be separated and be carried out through the nozzle together with the flow of air, thereby forming a central plume of airborne nuclei, whereas the remaining part of the swirling feeder water is pressed out through the nozzle in the form of a hollow cone of cooled or frozen water droplets surrounding the plume of nuclei; and the downstream end of the inner cone of the nozzle is formed with one or more cross slots or radially extending slots which brake(s) the movement of a little portion of the water flow in the swirl chamber and disintegrates said portion of the water so that it can be carried away and can be disintegrated into extremely small water droplets by the flow of air passing through the air channel.

2. Nozzle according to claim 1 characterized in that the nozzle is formed for a water pressure of about 6–10 bar and an air pressure at 4–5 bar and is designed so as to allow the air to pass through the nozzle with supersonic speed and without meeting an intermediate wall.

* * * * *